United States Patent [19]

Huray

[11] Patent Number: 4,592,541

[45] Date of Patent: Jun. 3, 1986

[54] MULTIPLE WORKHOLDING CLAMP ASSEMBLY AND ATTACHMENT MEANS

[76] Inventor: Istvan Huray, R.D. #4, Rte. 378, Bethlehem, Pa. 17401

[21] Appl. No.: 734,052

[22] Filed: May 15, 1985

[51] Int. Cl.[4] ..... B25B 1/20

[52] U.S. Cl. ..... 269/155; 269/156

[58] Field of Search ..... 269/152–156, 269/283, 97–98, 249, 43, 45

[56] References Cited

U.S. PATENT DOCUMENTS

| | | | |
|---|---|---|---|
| 812,699 | 2/1906 | Stevens | 269/98 |
| 918,192 | 4/1909 | Palmer | 269/152 |
| 961,983 | 6/1910 | Morse | 269/98 |
| 1,319,900 | 10/1919 | Reeder | 269/45 |
| 1,497,862 | 6/1924 | Lund | 269/249 |
| 1,987,826 | 1/1935 | Hevmann | 269/98 |
| 2,366,350 | 1/1945 | Ostling | 269/258 |
| 2,606,583 | 8/1952 | O'Connor | 269/249 |
| 2,778,393 | 1/1957 | Golasowski | 269/97 |
| 3,854,712 | 12/1974 | McGee | 269/152 |
| 4,141,542 | 2/1979 | Wolff | 269/98 |

FOREIGN PATENT DOCUMENTS

| | | | |
|---|---|---|---|
| 1249342 | 10/1971 | United Kingdom | 269/156 |

*Primary Examiner*—Robert C. Watson

*Attorney, Agent, or Firm*—Daniel J. O'Connor

[57] ABSTRACT

A plurality of clamping elements are centrally joined to provide an optimal and multiple workholding usage. The overall shape and particular angles utilized provide a workholder beneficial for craftsmen and hobbyists. Also disclosed are pipe holding attachments designed to be used with the system.

13 Claims, 4 Drawing Figures

MULTIPLE WORKHOLDING CLAMP ASSEMBLY AND ATTACHMENT MEANS

BACKGROUND OF THE INVENTION

This invention relates to a clamping assembly which provides maximum flexibility in the number of ways it may be used by craftsmen, hobbyists, welders, plumbers and cabinet makers.

It has been known in the prior art that a plural C-clamp structure would prove beneficial to craftsmen for holding work pieces. Some patents which illustrate the prior art teachings are as follows: U.S. Pat. Nos. 2,778,393 (Golasowski); 3,394,389 (Amir); 4,141,542 (Wolff); 2,606,583 (O'Connor); 2,366,350 (Ostling).

The Golasowski patent, for example, illustrates an adjustable C-clamp assembly for holding work pieces at various locations as desired. One problem with structures such as that shown in the Golasowski patent is that a workman must expend the time needed to adjust or set up the rather complex workholder itself, thus taking away from the time actually spent on the workpiece. The convenience of easily setting up a piece to be worked on is important and has not been successfully accomplished by systems such as that of Golasowski.

Other systems in the prior art such as that of the Ostling U.S. Pat. No. (2,366,350) have used angled clamping arrangements to hold a single central workpiece. Such work holders suffer the drawback of not being able to hold an enlarged or elongated piece of work. Their utility has thus proved limited in such professions as plumbing and cabinet making where multiple, elongated elements need to be firmly secured in place to have work performed on them.

A significant problem in the work holding arts has arisen when it is desired to hold an element which has differing thicknesses along its length. None of the prior art systems heretofore have successfully addressed this problem.

Ease of use for a wide variety of applications, the safety of the workman, and the protection of the workpiece by a firm holding have been realized to be desirable end results for work holding assemblies. However, none of the prior art systems have successfully combined these features into a single structure.

It has also been realized that a safe and easily used pipe holder attachment for clamping assemblies would prove highly beneficial to those of skill in the art.

OBJECTS OF THE INVENTION

Accordingly, it is an object of the present invention to provide a one-piece work-holding assembly which may be easily used in a number of different positions by craftsmen or hobbyists.

It is also an object of the invention to provide a work holder assembly which has utility in holding a variety of pieces including pieces whose thickness varies along their length.

It is a further object of the invention to provide a work holder which will be safe in use by a craftsman and provide increased protection to the work piece by firmly holding it in position.

It is also an object to provide safe and easily attached pipe holding means which may be used with the clamping assembly of the invention.

SUMMARY OF THE INVENTION

The invention provides a unique arrangement of C-clamp elements into a one-piece assembly. An end clamp is affixed to an axis about which four clamps are arranged in a manner to give maximum utility to the device.

The end clamp is formed to lie in substantially the same plane as two of the four clamps arranged about an axis. The remaining two clamping elements are arranged to lie at optimal angles to the plane formed by the end clamp and the two central clamping elements.

Pipe holding attachments have slots formed therein to slide along the bases of the various clamp subassemblies.

DETAILED DESCRIPTION OF THE INVENTION

Figure 1:
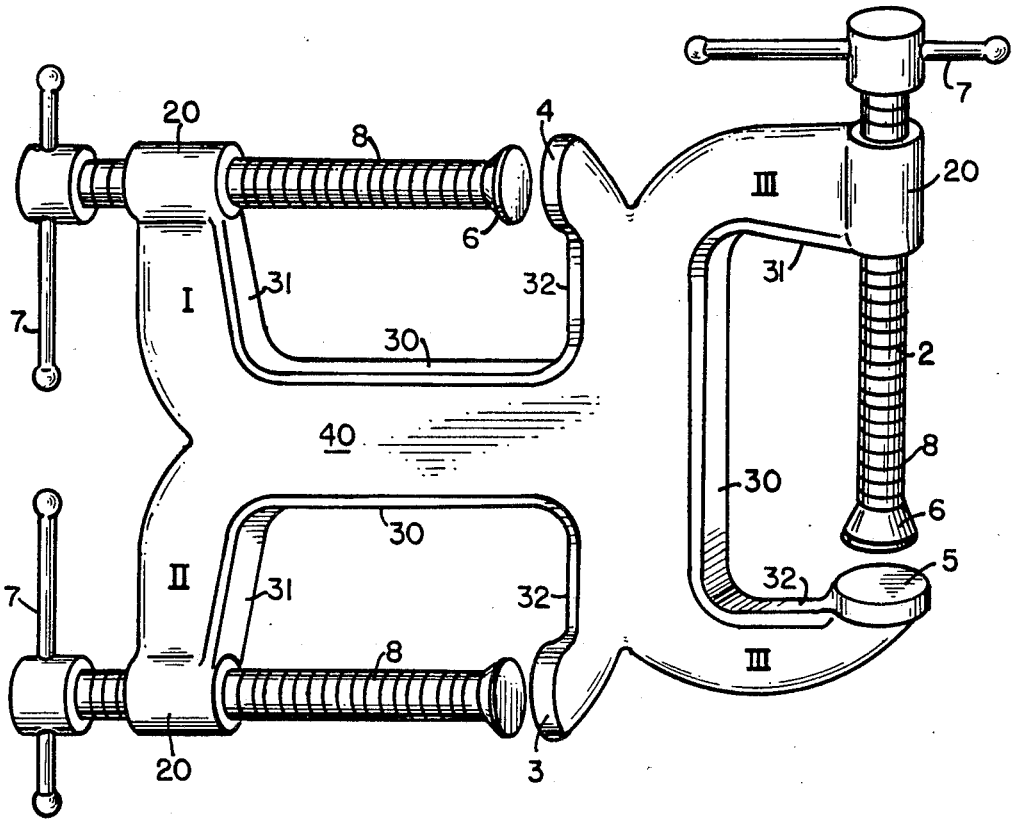
FIG. 1 shows a side view of the central portion of the overall assembly showing the end clamp and the two central clamps formed as a one-piece assembly.

Referring now to the drawing figures in detail, there is shown in FIG. 1 a central part of the completed assembly. Number 40 indicates a one-piece cast-iron structure which incorporates three clamps which lie in substantially the same plane.

The three clamp sections of the one-piece structure 40 are indicated at Roman numerals I, II and III respectively.

The end clamp section III has a central bar portion 30 and two arms 31 and 32. Arm 31 extends into an internally threaded aperture section 20 which receives a tightening screw 8 having threads 2 formed thereon. A conventional tightening handle is indicated at 7.

The end clamp section III extends in one-piece through area 40 and into the two central clamp sections shown at Roman numerals I and II. Each of the central clamp sections I and II have central bar elements 30 and arms 31 and 32. Arms 31 extend into threaded aperture sections 20 to receive tightening screws 8 with handles 7 mounted thereto.

As further shown in FIG. 1, each of the screws 8 have bearing plates 6 attached to the ends thereof opposite handles 7. These bearing plates 6 cooperate with fixed bearing plates 3, 4 and 5 extending from each of the arms 32. The adjustable bearing plates 6 and the fixed bearing plates 3, 4 and 5 thus act to perform the desired work holding and/or workholder mounting function.

It is contemplated that the three clamp sections of FIG. 1 would lie in substantially the same plane. However, in use, some variation from this planar arrangement may be used and still lie within the intended scope of the invention. For example, in a planar arrangement, the fixed bearing plates 3 and 4 would lie at 180 degrees from each other. It has been found that a spacing of 180 degrees plus or minus 5 degrees would be acceptable as to the location of plates 3 and 4.

Further, as shown in FIG. 1, the fixed bearing plate 5 of end clamp section III lies at 90 degrees to the fixed bearing plates 3 and 4. In practice, the fixed bearing plate 5 may lie at 90 degrees plus or minus 5 degrees in relation to plates 3 and 4.

Figure 2:
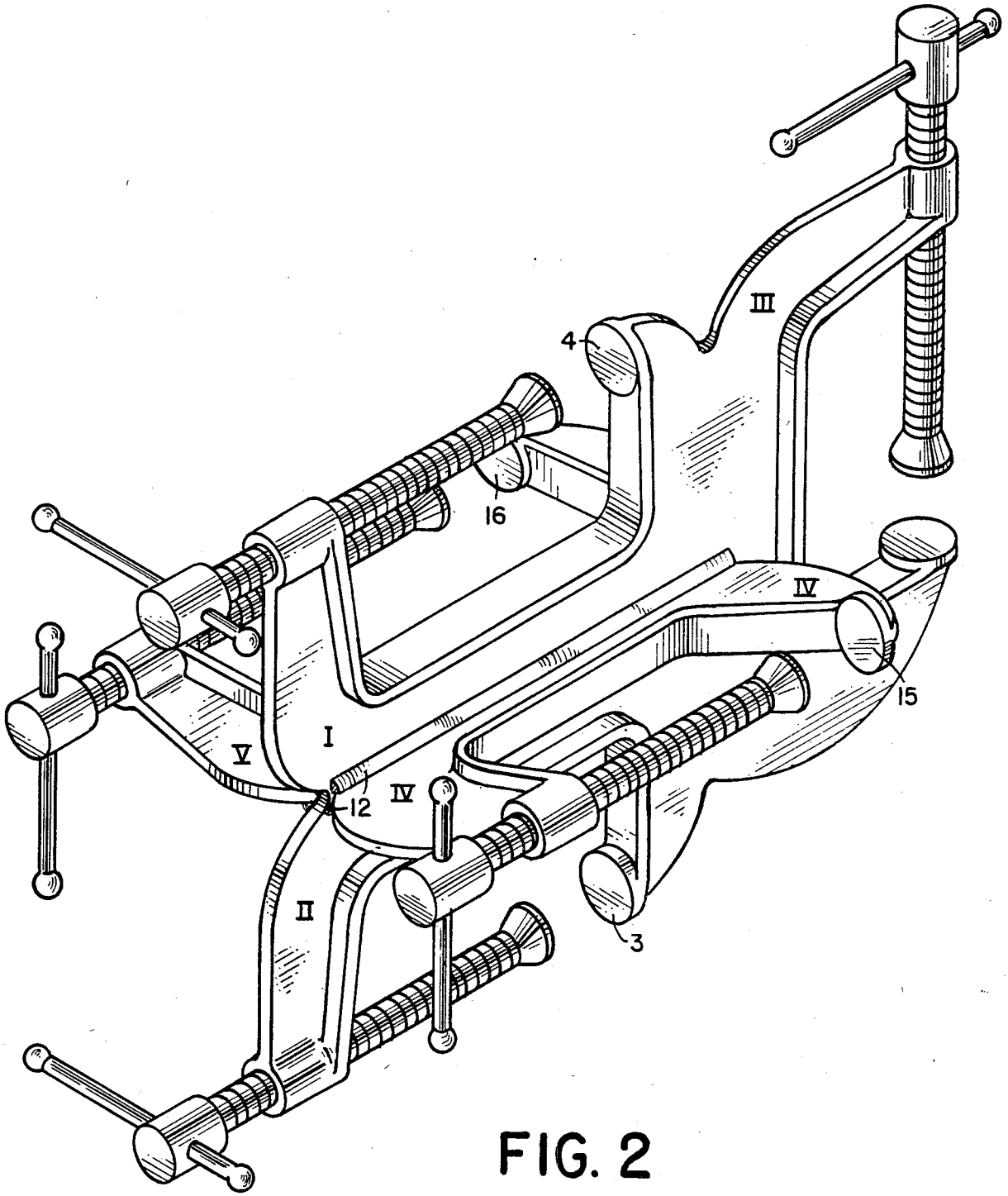
FIG. 2 shows an isometric view of the completed overall assembly including the central section of FIG. 1 with clamping sections IV and V added.

As shown in FIG. 2, the completed invention assembly has two additional clamping sections IV and V mounted to the base section of FIG. 1. These sections IV and V of FIG. 2 are mounted by weld connection to the line dividing clamping sections I and II. The weldment connection is shown schematically at 12 of FIG. 2.

Each of the clamping sections IV and V have a construction and component parts similar to that shown in FIG. 1 for clamping sections I, II and III.

The fixed bearing plates for clamping sections IV and V are indicated at 15 and 16, respectively. In practice of the invention, it has been found that clamping sections IV and V should be welded to the central base 40 such that they lie at a substantially 60 degree angle from the clamping section I. It has also been found that a variation of plus or minus 9 degrees from this 60 degree angle may be made while still allowing the device to perform in its intended manner.

This 60 degree plus or minus 9 degree welding of clamping sections IV and V to the central planar base 40 results in various mounting and work holding features of the invention as will be more fully described.

Figure 4:
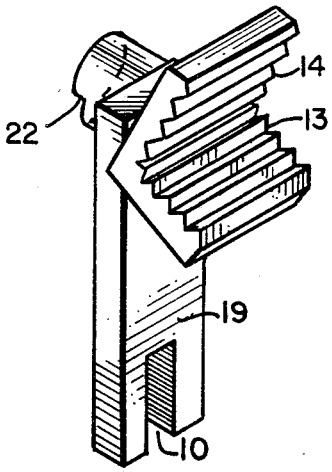
FIG. 4 shows a second pipe holder attachment means designed to cooperate with the first pipe holder attachment of FIG. 3.
Figure 3:
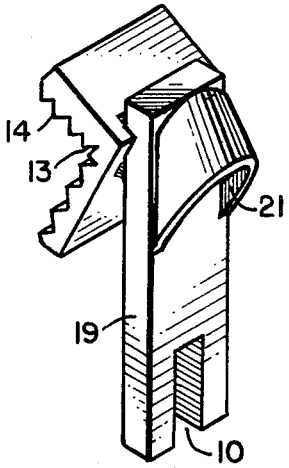
FIG. 3 shows a first pipe holder attachment for the overall clamping assembly.

Shown in FIGS. 3 and 4 are attachments for the overall clamping assembly to be used for pipe or rod holding. Each of the attachments shown in FIGS. 3 and 4 has a central base portion 19 with a slot 10 formed in the bottom thereof. Each of the slots 10 is sized and designed to slide along the central sections 30 of the various clamps. See FIG. 1 for illustration.

The pipe holding attachment of FIG. 3 has a shoe 21 welded to the central base 19 and the shoe 21 is adapted to fit over a fixed bearing plate such as that shown at 4 in FIG. 1.

Welded to the other side of base 19 is a V-shaped pipe grasping piece 13 having teeth 14 formed thereon. In practice of the invention for optimal use, it has been found that the angle of the V-shaped element 13 should be 118 degrees plus or minus 5 degrees.

The second pipe holding attachment is shown in FIG. 4 to have a V-shaped pipe grasping section welded to base 19. Slot 10 is used in a manner as described above. This V-shaped section would also have an angle of 118 degrees plus or minus 5 degrees. The attachment of FIG. 4 has a short pipe 22 welded to the other side of base 19 from the V-shaped grasping element 13.

The short pipe 22 is adapted to fit over the bearing plates 6 shown most clearly for illustration in FIG. 1. When the pipe holding attachments are located on bearing plates 3, 4, 5, 15 or 16 and on the moving bearing plates 6, the device can be used in a pipe work holding mode.

It should be noted that an important safety feature of the pipe holding attachments of FIG. 3 and 4 is that the short pipe 22 and the V-shaped elements 13 are sized so as to lie along the center of bearing plates 4 and 6, for example, so that maximum holding force can be applied to a pipe without the danger of slippage of the work holding attachments and consequent risk of injury to the craftsman or the pipe itself.

It can be seen from the overall construction of the device that it can be utilized in a wide variety of work holding positions. For example, any one of the five clamping sections I through V may be attached to a table or work bench leaving the other four sections free to hold work pieces. Clamping sections I, IV and V may be attached to a work table thus leaving sections II and III free to hold a workpiece. Because of the 60 degree angle between clamping sections I and IV and I and V respectively, it is possible to clamp only section I to a work table while still leaving sections IV and V available to hold workpieces.

It is significant that a large and varied number of work holding positions may be achieved without the need to change the configuration of the overall assembly as is required in prior art devices previously referred to.

It is also of importance in the work holding art that the arrangement of clamping sections I, IV and V allows a workpiece having varied thicknesses to be held firmly in position without damage to the workpiece.

These and other advantages of the present invention will become apparent to those of skill in the work holding arts as the device is used in practice and as described in the specification and claims appended hereto.

I claim:

1. A multiple clamping assembly comprising:

a first slamping section (I), a second clamping section (II), a third end clamping section (III), said first, second, and third clamping sections lying in substantially the same plane, said first, second, and third clamping sections being formed as a one-piece assembly (40), each of said first, second, and third clamping sections having a central base (30) and arms (31, 32) extending from said central base(,) at the ends of said central base portions (30), each of said clamping sections having a first arm (31) extending from said central base (30), said first arm (31) having means (20) formed therein for receiving a workholding element (8), said workholding element (8) having a bearing plate (6) attached to one end thereof and a handle means (7) attached to an opposite end thereof, each of said clamping sections having a second arm (32) extending from said central base (30), said second arm (32) having a fixed bearing plate (3, 4, 5) formed thereon, the central base portions (30) of the first, second, and third clamping sections (I, II, III) being formed as a permanent one-piece assembly joined at a central part (40) of the overall assembly, and wherein the central base portion (30) of said first clamping section (I) is in direct and contiguous contact with the central base portions (30) of said second (II) and third (III) clamping sections without any other intervening connecting means being utilized to join said three central base portions, wherein the workholding elements (8) lie at the peripherry of the overall assembly.

2. The multiple clamping assembly of claim 1 wherein the first and second clamping sections (I, II) are arranged so that the fixed bearing plates (3, 4) formed thereon are at an angle of 180 degrees plus or minus 5 degrees around the overall assembly from each other.

3. The multiple clamping assembly of claim 1 wherein the third clamping section (III) is arranged so that the fixed bearing plate (5) formed thereon is at an angle of 90 degrees plus or minus 5 degrees relative to the fixed bearing plates (3, 4) of the first and second clamping sections.

4. The multiple clamping assembly of claim 1 wherein the central part (40) of the overall assembly has a first side and a second side;

a fourth clamping section (IV) being mounted to said first side along a line joining said first and second clamping sections (I, II).

5. The multiple clamping assembly of claim 4 wherein a fifth clamping section (V) is mounted to said second side of the overall assembly along a line joining said first and second clamping sections (I, II).

6. The multiple clamping assembly of claim 4 wherein said fourth clamping section (IV) is mounted at an angle of 60 degrees plus or minus 9 degrees in relation to said first clamping section (I).

7. The multiple clamping assembly of claim 5 wherein said fifth clamping section (V) is mounted at an angle of 60 degrees plus or minus 9 degrees in relation to said first clamping section (I).

8. The assembly of claim 5 wherein said fourth and fifth clamping sections (IV, V) each include a central base portion (30), a first arm (31) extending from said central base portion, said first arm having means (2O) formed therein for receiving a workholding element (8), said workholding element (8) having a bearing plate (6) attached to one end thereof and a handle means (7) attached to the other end thereof, said fourth and fifth clamping sections further including a second arm (32) having a fixed bearing plate (15, 16) formed thereon.

9. The assembly of claim 8 wherein the fourth and fifth clamping sections are mounted such that the workholding elements (8) are located on the periphery of the overall device.

10. The assembly of claim 1 including a first pipe holding attachment means comprising:

a central section (19) having a slot (10) formed in a lower portion thereof, a shoe (21) means fixed to a first side of the pipe holding attachment adapted to fit over a fixed bearing plate (3, 4,5) of the overall assembly, a V-shaped pipe grasping element (13) having teeth (14) formed thereon fixed to the side of the central section opposite the shoe (21), wherein the first pipe holding attachment means is adapted to slide along one of the central base portions (30) of the overall clamping assembly.

11. The assembly of claim 10 wherein the V-shaped pipe grasping element (13) is formed having an angle of 118 degrees plus or minus 5 degrees.

12. The assembly of claim 1 including a second pipe holding attachment means comprising:

a central section (19) having a slot (10) formed in a lower portion thereof, a short pipe section (22) mounted to a first side of said central section (19) and adapted to fit over a bearing plate (6) of each of the clamping sections, a V-shaped pipe grasping element (13) having teeth (14) formed thereon mounted to a second side of said central section (19), wherein said second pipe holding attachment means is adapted to slide along one of the central base portions (30) of the overall clamping assembly.

13. A multiple clamping assembly comprising:

a first clamping section (I), a second clamping section (II), a third end clamping section (III), said first, second, and third clamping sections lying in substantially the same plane, said first, second, and third clamping sections being formed as a one-piece assembly (40), each of said first, second, and third clamping sections having a central base (30) and arms (31, 32) extending from said central base, each of said clamping sections having a first arm (31) extending from said central base (30), said first arm (31) having means (20) formed therein for receiving a workholding element (8), said workholding element (8) having a bearing plate (6) attached to one end thereof and a handle means (7) attached to an opposite end thereof, each of said clamping sections having a second arm (32) extending from said central base (30), said second arm (32) having a fixed bearing plate (3, 4, 5) formed thereon, the central base portions (30) of the first, second, and third clamping sections (I, II, III) being formed as a permanent one-piece assembly joined at a central part (40) of the overall assembly, wherein the workholding elements (8) lie at the periphery of the overall assembly, wherein the central part (40) of the overall assembly has a first side and a second side;

a fourth clamping section (IV) being mounted to said first side along a line joining said first and second clamping section (I, II).

* * * * *